United States Patent [19]

Patti

[11] Patent Number: 4,619,618

[45] Date of Patent: Oct. 28, 1986

[54] FRESH WATER FLUSHING KIT

[76] Inventor: William Patti, 865 Robin Ct., Marco Island, Fla. 33937

[21] Appl. No.: 722,345

[22] Filed: Apr. 12, 1985

[51] Int. Cl.[4] ..... B63H 21/38

[52] U.S. Cl. ..... 440/88; 440/900; 137/240

[58] Field of Search ..... 440/88, 113, 900, 111; 137/240; 134/169 A

[56] References Cited

U.S. PATENT DOCUMENTS 3,183,880 5/1965 Shimanckas ..... 440/88 X 3,283,498 11/1966 Connell ..... 440/88 X 3,550,612 12/1970 Maxon ..... 440/88 X 4,133,284 1/1979 Holcroft ..... 440/88

*Primary Examiner*—Sherman D. Basinger

*Assistant Examiner*—Paul E. Salmon

*Attorney, Agent, or Firm*—Eugene F. Malin

[57] ABSTRACT

A fresh water flushing kit easily adaptable for insertion in various types of inboard/outboard marine engines cooling systems. The kit includes a conduit system so constructed for utility in an inboard/outboard marine engine having one water pump adjacent the engine block and an additional pump in the outdrive unit. This conduit is provided with an inlet for fresh water and an ancillary outlet for discharge of sea water overboard during an engine flushing cycle.

4 Claims, 4 Drawing Figures

FRESH WATER FLUSHING KIT

BACKGROUND OF THE INVENTION

The present invention is to a flushing kit that is easily connectable to various types of inboard/outboard marine engines and inboard marine engines to allow normal operation of the engine and to allow the engine cooling system to be quickly and efficiently flushed out with fresh water.

In the past, the engine cooling system of inboard/outboard marine engines and inboard marine engines had to be removed from the water to be thoroughly flushed out with fresh water. The present inventions allows a flushing kit to be installed quickly and used in an efficient three step operation or four step operation. The invention utilizes a first embodiment that is useful in inboard marine engines and inboard/outboard marine engines having a single cooling water pump adjacent the engine block. The invention utilizes a second embodiment that is similar to the first embodiment but includes an additional outlet and an additional valve that is used in inboard/outboard marine engines having an additional pump in the outdrive unit.

BRIEF DESCRIPTION OF THE INVENTION

The fresh water flushing kit is used as an insert into the sea water cooling inlet hose in an inboard/outboard marine engine or in an inboard marine engine. A first type of marine engine that the flushing kit will be used with is either an inboard marine engine or an inboard/-outboard marine engine with a single cooling water pump. A second type of inboard/outboard marine engine has one water pump adjacent the engine block and an additional pump in the outdrive unit. The fresh water flushing kit, when used on the first type or second type of marine engine includes a conduit that is connected into the existing sea water cooling inlet hose. The flushing kit's conduit is placed in the middle of the sea water cooling inlet hose, with one end of the severed sea water cooling inlet hose connected to the inlet side of the conduit and with the other end of the severed sea water cooling inlet hose connected to the outlet side of the conduit. New hose pieces may be used when connecting the conduit. The conduit has an inlet that is connected to the inlet portion of the sea water cooling inlet hose of the marine engine to receive sea water from the intermediate housing or the sea cock. The conduit has an outlet that is connected to the outlet portion of the sea water cooling inlet hose of the marine engine to pass sea water into the thermostat and the engine block.

The conduit includes an intermediate shut off valve means operably located between the inlet and the outlet. The conduit includes a secondary inlet for the introduction of fresh water into the conduit for flushing purposes. The secondary inlet is operably connected to the conduit between the outlet and the intermediate shut off valve. The secondary inlet includes a closure means that is used to close the secondary inlet when the marine engine is operating in a normal manner and is removable in order to insert a fresh water hose to provide a source of flushing water.

In the second embodiment of the flushing kit that is used with the second type of inboard/outboard with an additional water pump located in the outdrive unit the conduit is identical to the conduit described above but also includes a secondary or additional outlet with a secondary or additional valve means connected to the conduit between the inlet and the intermediate shut off valve means. The additional outlet and additional valve means are used to allow sea water pumped from the pump in the outdrive unit overboard through a hose during the engine flushing cycle.

The method of use of the flushing kit and the conduit of the first type of inboard marine engine and outboard-/inboard marine engine is shown in FIGS. 1 and 3. The method of use begins with the initial step of inserting the conduit into the sea water inlet hose in a inboard marine engine or in an inboard/outboard marine engine that does not have an outdrive pump unit. The conduit may be secured in place to pass water therethrough by hose clamps. The inlet cooling water hose is removed or cut to allow the conduit to be connected by ordinary hose clamps or other connectors between the sea cock or the intermediate housing adjacent the outdrive unit and the thermostat housing that is connected to the engine block. The marine engine is then in condition to operate normally with the intermediate valve means in an open position allowing sea water coolant to pass through the conduit.

The flushing cycle is begun by shutting off the engine. Then, the conduit's intermediate shut off valve means that is in an open position for normal operation of the marine engine is closed. The secondary inlet's closure is opened and a fresh water input hose is connected to the secondary inlet to supply fresh water for flushing purposes. The outlet of the conduit that is connected to the thermostat housing passes the fresh water into the engine block. When the marine engine is started fresh water is passed through the engine block and cooling system to the overboard outlet in an inboard engine or through the engine block and cooling system to the overboard outlet in the outdrive in an inboard/outboard engine.

Once the engine block and engine cooling system is flushed of salt water, a third step is initialed by shutting down the marine engine. Thereafter the intermediate valve is opened in order to allow fresh water to back flush the inlet line to the sea cock in an inboard engine or the inlet line to a portion of the intermediate housing and outdrive unit in the first type of inboard/outboard marine engine. The fresh water flows out through the sea water intake port. Thereafter the fresh water from a hose connection is shut off and removed and the fresh water secondary inlet is shut off and capped by securing the closure means. The marine engine is then ready for normal use.

The method of use of the flushing kit and conduit shown in FIGS. 2 and 4 is the same manner as steps one, two and three set forth above except that an additional fourth step is required for the second type of inboard/-outboard marine engines having an outboard pump as illustrated in FIG. 4. The inboard/outboard marine engine with an outdrive pump in FIG. 4 is shown with an outdrive pump unit. During the fourth step the secondary outlet is connected to one end of an overboard hose. The other end of the overboard hose dumps water over the side of the boat. The additional valve is opened during the fourth step. It should be noted that during the second step the pump in the engine block is utilized to move fresh water from the outlet of the conduit through the engine and cooling system and out through a portion of intermediate housing and the outdrive unit when the engine is operating. During the operation of the marine engine, the outdrive pump unit forces salt water through the other portion of the outdrive unit and intermediate housing and out through the secondary outlet past the additional valve and to the overboard hose. When the marine engine is shut down and the second and third steps are initiated the additional valve is shut off at the same time the intermediate valve is opened. Fresh water is passed into the conduit through the intermediate shut off valve to back flush the other portion of the intermediate housing and the other portion of the outdrive unit. The fresh flushing water is forced out the sea water intake. Thereafter the fresh water is disconnected and the secondary inlet means is capped. The marine engine is then ready for normal operation.

It is an object of this invention is to provide a fresh water flushing kit that is easily installed with minimal effort and is operated by a noncomplex flushing method.

Another object of the invention is to provide a low cost flushing kit that requires minimal work for installation and may be left in place during normal operation of the vessel.

In accordance with these and other objects which will be apparent hereinafter, the instant invention will now be described with particular reference to the accompanying drawings.

DESCRIPTION OF THE PREFERRED EMBODIMENT

Figure 3:
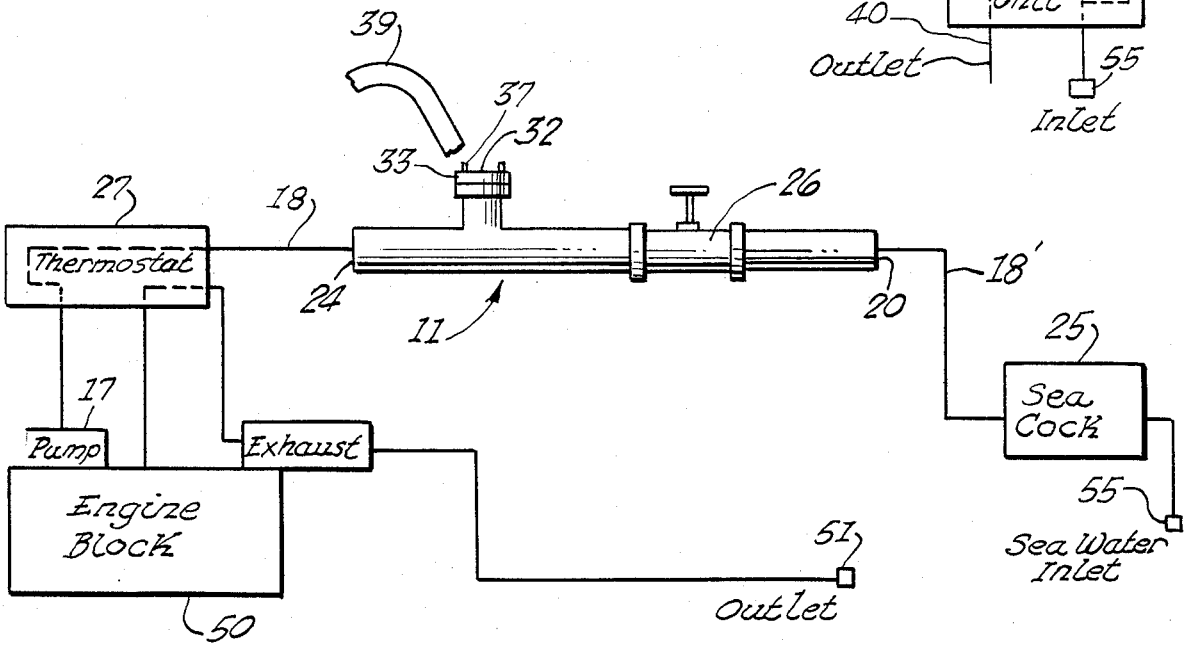
FIG. 3 is a partial block diagram illustrating the fresh water flushing kit in use with the conduit of FIG. 1 in the first type of inboard marine engine or inboard/outboard marine engine.

Referring now to the drawing, the present invention is to a flushing kit that is easily connectable to various types of inboard/outboard marine engines and inboard marine engines to allow normal operation of the engine and to allow the engine cooling system to be quickly and efficiently flushed out with fresh water. The present inventions allow a flushing kit to be installed quickly and used in an efficient three step operation or four step operation. The invention utilized a first embodiment that is useful in inboard marine engines and inboard/-outboard marine engines having a single cooling water pump 17 adjacent the engine block 50 as shown in FIG. 3. The invention utilizes a second embodiment that is similar to the first embodiment but includes an additional outlet 28 and an additional valve 30 that is used in inboard/outboard marine engines having a pump 19 and having an additional pump 21 in the outdrive unit 22 as shown in FIG. 4.

Figure 2:
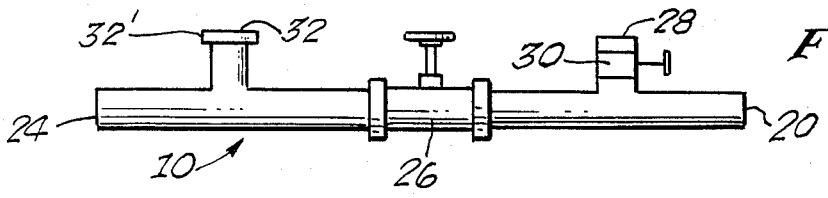
FIG. 2 is the second embodiment of the conduit from the fresh water flushing kit.
Figure 1:
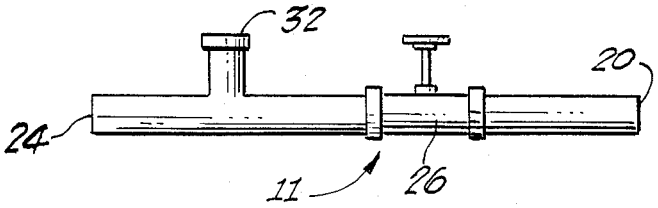
FIG. 1 is a side view of the first embodiment of the conduit from the fresh water flushing kit.

The fresh water flushing kit is used as an insert into the sea water cooling inlet hose 16, 16' or 18, 18' in an inboard/outboard marine engine or in an inboard marine engine. A first type of mairne engine that the flushing kit will be used with is either an inboard marine engine or an inboard/outboard marine engine with a single cooling water pump 17 as shown in FIGS. 1 and 3. A second type of inboard/outboard marine engine that the flushing kit will be used with has one water pump 19 adjacent the engine block and an additional pump 21 in the outdrive unit as shown in FIGS. 2 and 4. The fresh water flushing kit, when used on the first type or second type of marine engine includes a conduit 10 or 11 that is connected into the existing sea water cooling inlet hose 16, 16' or 18, 18'. The flushing kit's conduit is placed in the middle of the sea water cooling inlet hose, with one end of the severed sea water cooling inlet hose 18' connected to the inlet side 20 of the conduit 11 and with the other end 18 of the severed sea water cooling inlet hose connected to the outlet 24 side of the conduit 11. New hose pieces may be used when connecting the conduit. The conduit 11 has an inlet 20 that is connected to the inlet portion of the sea water cooling inlet hose 18' of the marine engine to receive sea water from a portion of the intermediate housing 34 or the sea cock 25. The conduit 11 has an outlet 24 that is connected to the outlet portion 18 of the sea water cooling inlet hose of the marine engine to pass seawater into the thermostat 27 and the engine block 50.

The conduit includes an intermediate shut off valve means 26 operably located between the inlet 20 and the outlet 24. The conduit 11 includes a secondary inlet 32 for the introduction of fresh water into the conduit for flushing purposes. The secondary inlet 32 is operably connected to the conduit between the outlet 24 and the intermediate shut off valve 26. The secondary inlet includes a closure means 33 that is used to close the secondary inlet 32 when the marine engine is operating in a normal manner and is removable by removing bolts 37 in order to insert a fresh water hose 39 to provide a source of flushing water.

Figure 4:
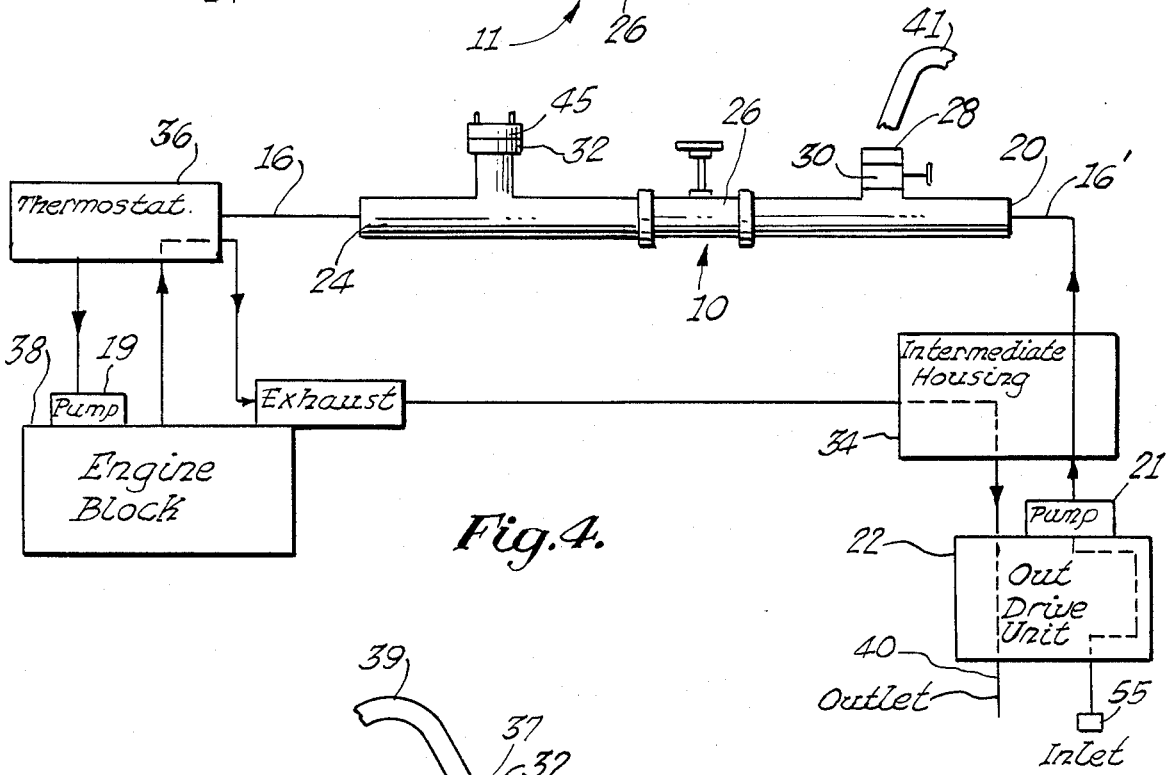
FIG. 4 is a partial block diagram illustrating the fresh water flushing kit in use with the conduit of FIG. 2 in the second type of inboard/outboard marine engine.

In the second embodiment shown in FIGS. 2 and 4 of the flushing kit that is used with the second type of inboard/outboard with an additional water pump 21 located in the outdrive unit 22 has a conduit 10 identical to the conduit 11 described above but also includes a secondary or additional outlet 28 with a secondary or additional valve means 28 connected to the conduit 10 between the inlet 20 and the intermediate shut off valve means 26. The additional outlet 28 and additional valve means 30 are used to allow sea water pumped from the pump 21 in the outdrive unit 22 overboard through a hose 41 during the engine flushing cycle.

The method of use of the flushing kit and the conduit 11 of the first type of inboard marine engine and outboard/inboard marine engine is shown in FIGS. 1 and 3. The method of use begins with the initial step of inserting the conduit 11 into the sea water inlet hose that lies between intermediate housing 34 and thermostat housing 36 in an inboard marine engine or in an inboard/outboard marine engine that does not have an outdrive pump unit. The conduit 11 may be secured in place to pass water therethrough by hose clamps of any well known type. The inlet cooling water hose is removed or cut, as shown, to allow the conduit 11 to be connected by ordinary hose clamps or other connectors between the sea cock 25 in FIG. 3 or the intermediate housing 34 as shown in FIG. 4 adjacent the outdrive unit 22 as shown in FIG. 4 and the thermostat housing 27 that is connected to the engine block 50. The marine engine is then in condition to operate normally with the intermediate valve means 26 in an open position allowing sea water coolant to pass through the conduit 11.

The flushing cycle is begun by shutting off the engine. Then, the conduit's intermediate shut off valve means 26 that is in an open position for normal operation of the marine engine is closed. The secondary inlet's closure 33 is opened and a fresh water input hose 39 is connected to the secondary inlet 32 to supply fresh water for flushing purposes. The outlet of the conduit that is connected to the thermostat housing passes 27 the fresh water into the engine block 50. When the marine engine is started fresh water is passed through the engine block 50 and cooling system such as the exhaust manifolds to the overboard outlet 51 in an inboard engine or through the engine block and cooling system to the overboard outlet in the outdrive in an inboard/outboard engine.

Once the engine block and engine cooling system is flushed of salt water, a third step is initiated by shutting down the marine engine. Thereafter the intermediate valve 26 is opened in order to allow fresh water to back flush the inlet line to the sea cock 25 in an inboard engine or the inlet line to a portion of the intermediate housing and outdrive unit in the first type of inboard/-outboard marine engine. The fresh water flows out through the sea water intake port 53. Thereafter the fresh water from a hose connection is shut off and removed and the freshwater secondary inlet is shut off and capped by securing the closure means 33. The marine engine is then ready for normal use.

The method of use of the flushing kit and conduit shown in FIGS. 2 and 4 is the same manner as steps one, two and three set forth above except that an additional fourth step is required for the second type of inboard/-outboard marine engines having an outboard pump as illustrated in FIG. 4. The inboard/outboard marine engine with an outdrive pump in FIG. 4 is shown with an outdrive pump unit 21. During the fourth step the secondary outlet 28 is connected to one end of an overboard hose 41. The other end of the overboard hose dumps water over the side of the boat. The additional valve 30 is opened during the fourth step. It should be noted that during the second step the pump 19 in the engine block 38 is utilized to move fresh water from the outlet 24 through the engine and cooling system and out through a portion of intermediate housing 34 and the outdrive unit 22 when the engine is operating. During the operation of the marine engine, the outdrive pump unit 21 forces salt water through the other portion of the outdrive unit 22 and intermediate housing 34 and out through the secondary outlet 28 past the additional valve 30 and to the overboard hose 41. When the marine engine is shut down and the second and third steps are initiated the additional valve is shut off at the same time the intermediate valve is opened. Fresh water is passed into the conduit 10 throught he intermediate shut off valve 26 to back flush the other portion of the intermediate housing 34 and the other portion of the outdrive unit. The fresh flushing water is forced out the sea water intake 55. Thereafter the fresh water is disconnected and the secondary inlet means is capped by member 45. The marine engine is then ready for normal operation.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A fresh water flushing kit adapted for use only as an insertion in or as a permanent component in a cooling conduit system of an inboard marine engine system or an inboard/outboard marine engine system wherein the engine system includes an outboard cooling water hose water inlet, an outboard cooling pump, an intermediate housing including a passageway communicating with the pump, and an engine thermostat housing, said kit comprising:

a replacement conduit having an inlet means connectable to the outboard cooling water hose inlet via the intermediate housing;

said conduit including an outlet means connectable to the engine thermostat housing;

the conduit including an intermediate shut off valve means disposed between said inlet and said outlet means;

the conduit including a secondary outlet means with valve means disposed between said inlet means and said intermediate shut off valve means; and the conduit including a secondary inlet means for fresh water disposed between said outlet means and said intermediate shut off valve, said secondary inlet means including a closure means.

2. A fresh water flushing kit as set forth in claim 1, wherein:

said valve for said secondary outlet means and said intermediate shut off valve function to flush the outboard/inboard and said outboard pump.

3. Method of flushing an inboard/outboard marine engine having a cooling block pump, an outdrive unit with a sea water inlet, an outdrive cooling pump with an outlet, an engine block with a cooling system having a cooling water inlet, and a cooling water hose, said method comprising the steps of:

providing means in or as a replacement for the cooling water hose disposed between the outdrive and the engine block comprising a conduit from a flushing kit;

connecting the conduit from a flushing kit, said conduit having an inlet, an outlet, an intermediate shut off valve, a secondary outlet with a valve with a inlet connected between said inlet and said intermediate shut off valve inlet, and a secondary inlet with a closure means connected between said outlet and said intermediate shut off valve;

connecting said conduit inlet to the outlet of the outdrive cooling pump;

connecting said conduit outlet to the cooling water inlet of the cooling system of the engine block;

connecting said secondary outlet to dump cooling sea water overboard when the secondary outlet valve is opened to provide an exit for said cooling sea water from the outdrive cooling pump;

closing said intermediate shut off valve; providing a fresh water source;

opening said closure means and connecting a source of fresh water from the fresh water source to said secondary inlet;

passing fresh water into said kit conduit through said secondary inlet;

starting the engine;

running the engine cooling block pump to move fresh water through the engine block and out through the outdrive unit;

then shutting off the engine;

opening said intermediate valve; and closing said secondary outlet valve to allow fresh water to flow via said intermediate valve and out through said conduit inlet and out through the sea water inlet in the outdrive.

4. In a marine engine having a coolant system comprising an outdrive unit including a sea water inlet and a pump with an outlet for circulating coolant sea water, an engine block including a pump having an inlet and a sea water discharge outlet, and a thermostat, a hose for circulating sea water from the outdrive unit to said engine block, the improvement wherein said hose includes a fresh water flushing system comprising:

(a) a conduit disposed between the opposed ends of said hose and communicating therewith, said conduit having inlet means connected to the sea water pump outlet of the outdrive unit and said conduit including outlet means communicating with the inlet of the pump of the engine block;

(b) said conduit including shut-off valve means disposed between said inlet means and said outlet means;

(c) said conduit further including a secondary outlet with valve means disposed between said inlet means and said shut-off valve means for discharging sea water, and (d) said conduit including a secondary inlet means for receiving fresh water, said secondary inlet means being located between said outlet means and said shut-off valve and including closure means therefor.

* * * * *